US006505352B2

(12) United States Patent
Chiang

(10) Patent No.: US 6,505,352 B2
(45) Date of Patent: Jan. 14, 2003

(54) SWIMMING GOGGLES

(76) Inventor: Herman Chiang, 11F-2 No 634-9 Ching-ping Rd., Chung-Ho City, Taipei Hsien (TW)

( * ) Notice: Subject to any disclaimer, the term of this patent is extended or adjusted under 35 U.S.C. 154(b) by 0 days.

(21) Appl. No.: 09/863,235

(22) Filed: May 21, 2001

(65) Prior Publication Data

US 2002/0170108 A1 Nov. 21, 2002

(51) Int. Cl.[7] ..... A61F 9/02
(52) U.S. Cl. ..... 2/428
(58) Field of Search ..... 2/428, 452, 426; 351/43

(56) References Cited

U.S. PATENT DOCUMENTS 5,651,146 A * 7/1997 Chao ..... 2/431
6,119,277 A * 9/2000 Chiang ..... 2/428
6,247,187 B1 * 6/2001 Chiang ..... 2/428
6,349,417 B1 * 2/2002 Chiang ..... 2/428

* cited by examiner

*Primary Examiner*—John J. Calvert
*Assistant Examiner*—Katherine Moran
(74) *Attorney, Agent, or Firm*—Troxell Law Office PLLC

(57) ABSTRACT

A pair of swimming goggles for swimming pool purposes comprising: a left lens frame, a right lens frame, two lens units and a strap mean, each of lens frames has an inner periphery that defines a lens retaining space for receiving a lens unit and the periphery of each lens frame have at least one connection base. A strap mean for passing through the connection base of each of lens frames and tightening the swimming goggles to a wearer's head, such the swimming goggles can effectively guard against interference each other during the adjusting and can respectively conform with a wearer's eyehole contour, so as to provide more comfortable fitting and prevent the seepage of water when the swimming goggles are in use.

5 Claims, 11 Drawing Sheets

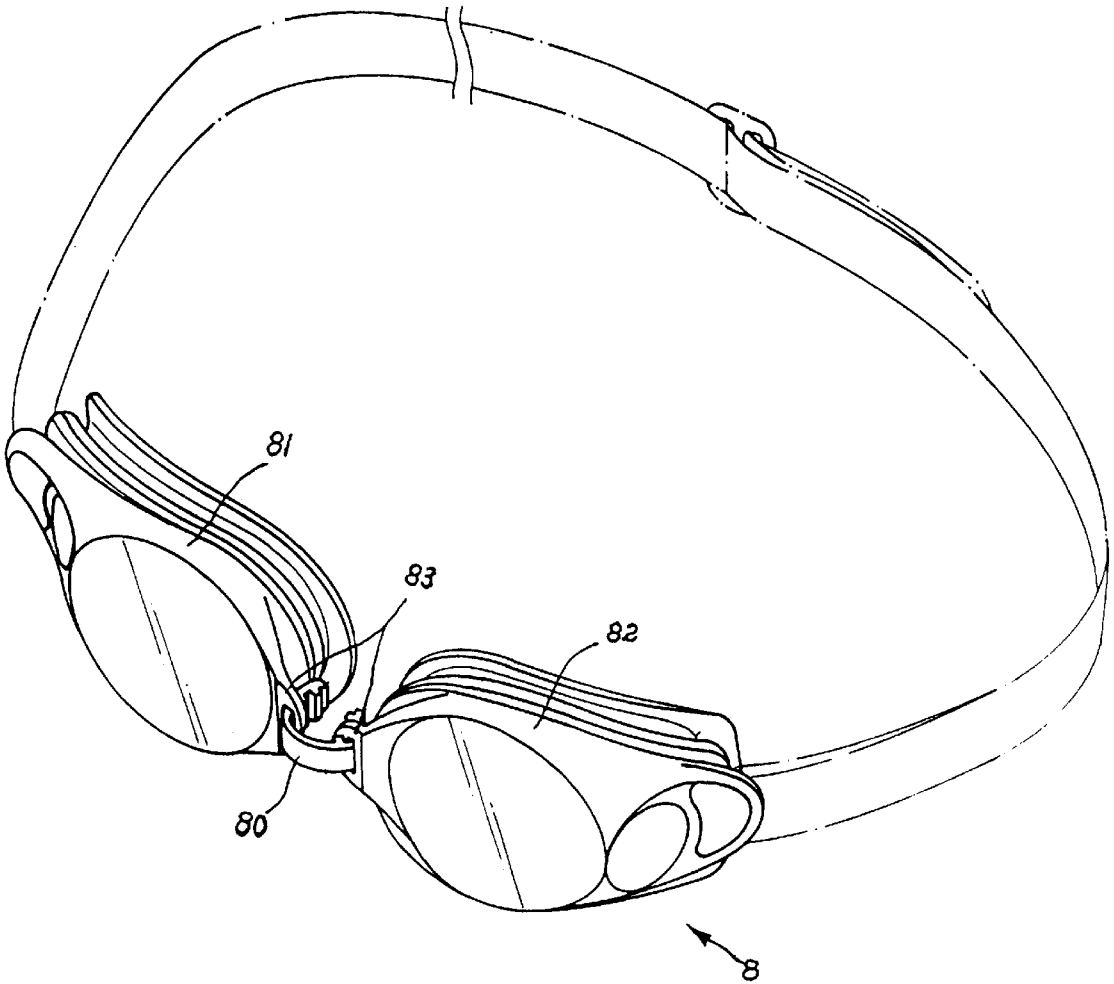
PRIOR ART *FIG.1*

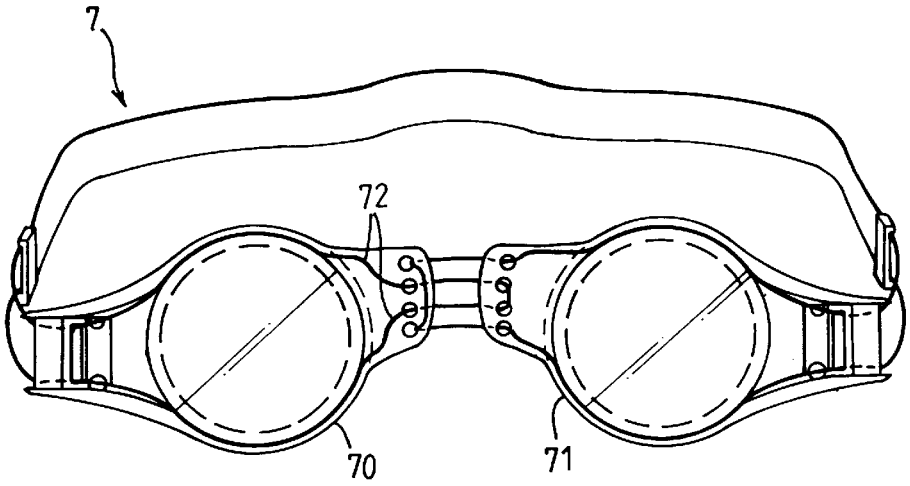
PRIOR ART *FIG.2*
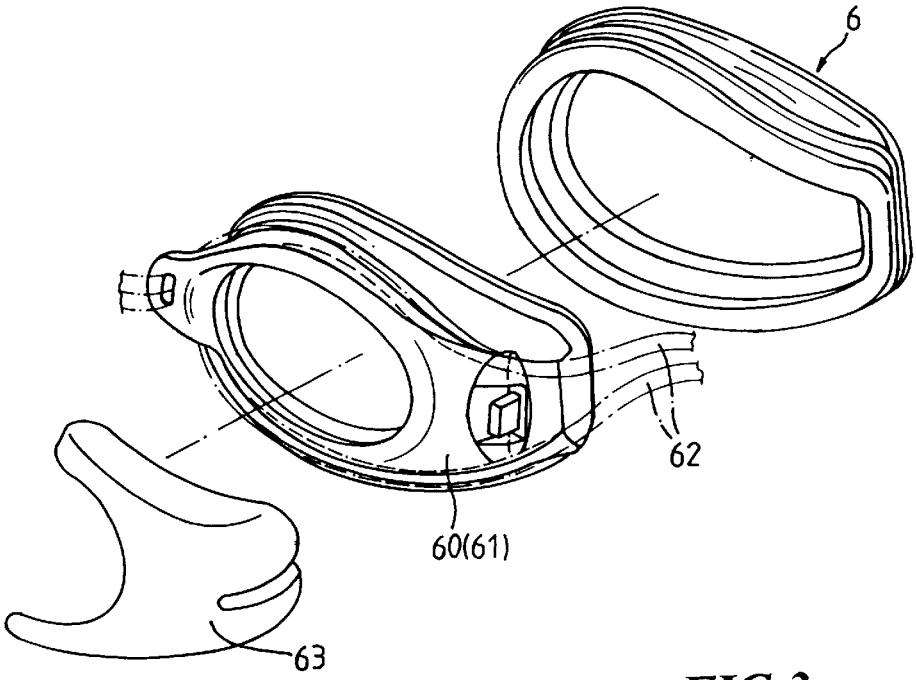
PRIOR ART *FIG.3*

SWIMMING GOGGLES

FIELD OF THE INVENTION

The present invention relates to a swimming goggles, more particularly to a pair of swimming goggles which have two lens frames that can effectively guard against interference each other during the adjusting and can respectively conform with a wearer's eyehole contour, so as to provide more comfortable fitting and prevent the seepage of water when the swimming goggles are in use.

BACKGROUND OF THE INVENTION

Conventionally, a swimming goggles has an adjustment element for adjusting a span between a left lens frame and a right lens frame. Nevertheless, this is so because the span between two eyes as well as the eyehole's contour may be different from person to person, thereby the left lens frame and the right lens frame of all types of swimming goggles can not respectively match wearer's eyehole contour and result the each lens frame unable to present the seepage of water when swimming goggles are in use. Referring to FIG. 1, a pair of swimming goggles 8 comprise a bridge 80, a right lens frame 81 and a left lens frame 82, the bridge 80 have two ends which respectively are connected to a connection base 83 of the right lens frame 81 and the left lens frame 82, which makes the right lens frame 81 and the left lens frame 82 influence each other when adjusting a span of the bridge. Moreover, the bridge 80 is limited the span which adjust between the right lens frame 81 and the left lens frame 82 in which the right lens frame 81 and the left lens frame 82 synchronously are moved with far away or closely each other, thereby adjusting the right lens frame 81 (or the left lens frame 82) to be in conformity with the periphery of right eyehole (or left eyehole) will move the left lens frame 82 (or the right lens frame 81) during the swimming goggles are worn on the wearer's eyeholes. In other words, the right lens frame 81 and the left lens frame 82 never respectively match wearer's eyehole contour thereby leading to uncomfortable fitting and facile the seepage of water when the swimming goggles are in use.

Referring to FIG. 2 and FIG. 3, the other two type of a pair of swimming goggles 6, 7 which have two straps that be respectively connected to a lens frames of each swimming goggles. As FIG. 2 the swimming goggles 7 have two lens frames 70,71 which are respectively connected together with interlacing by two straps 72. During adjusting, it is necessary to take off the swimming goggles 7 firstly, and then respectively adjusted the strap 72 adapt to the size of the nose bridge of wearer, finally wearing the swimming goggles 7 on the head of wearer. This way is inconvenient to wearer that should take off the swimming goggles 7 every adjusting, more particularly to the swimming goggles 7 is same situation with the aforementioned swimming goggles 8 which is adjusted one of the lens frame 70 (or the lens frame 71) to be in conformity with the periphery of right eyehole (or left eyehole) will move the lens frame 71 (or the lens frame 70) during the swimming goggles are worn on the wearer's eyeholes. In other words, both the lens frames 70, 71 never respectively match wearer's eyeholes contour.

As show in FIG. 3, the swimming goggles 6 are connected a lens frames 60(61) by two straps 62 and the two straps 62 are clipped by a position element 63, thereby to provide the two straps 62 securely position with the lens frames 60(61). During adjusting, it is necessary to take off the swimming goggles 6, besides it is also necessary to take off the position element 63 and should be repeated several times to do the adjusting and wearing. Moreover, the swimming goggles 6 are same situation with the aforementioned swimming goggles 7,8, it should be to happen that is adjust one of the lens frame 60 (61; not show) to be in conformity with the periphery of left eyehole (or right eyehole) will move the other lens frame 61 (60) during the swimming goggles 6 are worn on the wearer's eyeholes. In other words, both the lens frames 60(61) never respectively match wearer's eyeholes contour.

OBJECTS OF THE INVENTION

The object of the present invention is to provide a swimming goggles that can overcome the drawback of the aforementioned prior art.

More specifically, the main object of the present invention is to provide a pair of swimming goggles which capable of adjusting a left and a right lens frames of the swimming goggles respectively to match with each of an user's eyehole, and never affect positing when the swimming goggle is in adjusting so as to provide securely matching with the periphery of wearer's eyeholes respectively and get more Comfortable and prevent effectively the seepage of water when the swimming goggles are in use.

To achieve the above objects, the present invention is featured in that a swimming goggles have a first connection base and a second connection base which be mounted on an upper and lower portions respectively of an outer periphery of each of a left lens frame and a right lens frame of the swimming goggles, wherein the first connection base comprises a first slot formed on the upper portion of the outer periphery of the lens frame; and an opening in the upper portion of the outer periphery of the lens frame; the second connection base comprises a second slot formed on the lower portion of the outer periphery of the lens frame; and an opening in the lower portion of the outer periphery of the lens frame. Strap means including a first strap and a second strap capable of passing through the upper and lower portions respectively of the outer periphery of each of the left lens frame and the right lens frame so as to assist tightening of the swimming goggles to a wearers head.

BRIEF DESCRIPTION OF THE DRAWINGS

Other features and advantages of the present invention will become apparent in the following detailed description of the preferred embodiments with reference to the accompanying drawings of which:

FIG. 1 to FIG. 3 are a perspective view of swimming goggles of the prior art;

DETAILED DESCRIPTION OF THE PREFERRED EMBODIMENT

Figure 4:
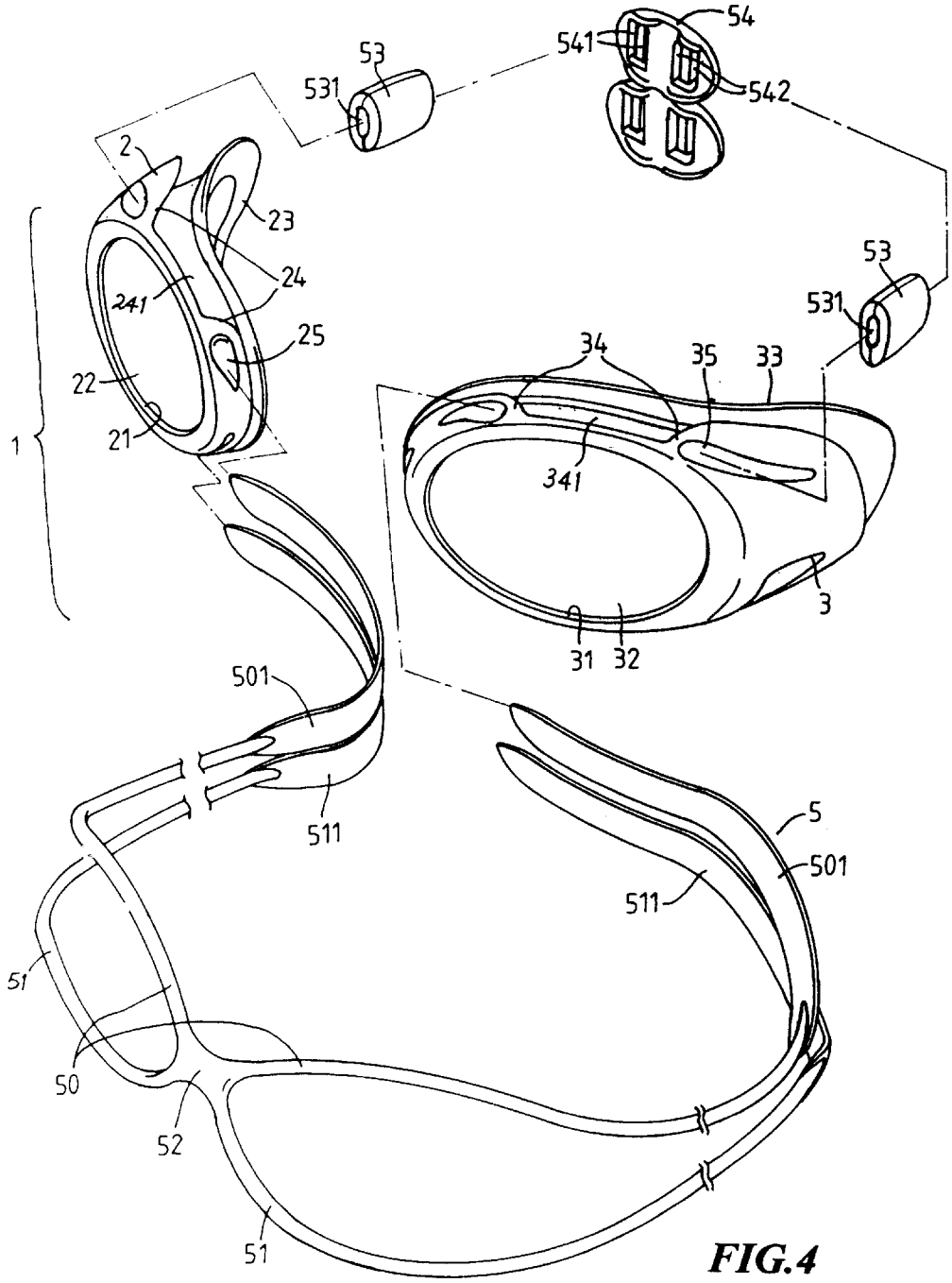
FIG. 4 is a perspective view of the disassembled parts of the swimming goggles of the present invention.

Referring to FIG. 4, the preferred embodiment of a swimming goggles 1 according to the present invention is show to comprise a right lens frame 2, a left lens frame 3 and a strap mean 5, wherein each of the lens frames 2,3 has a lens retaining spaces 21,31 for insert molding a lens units 22,32 thereon. The right lens frame 2 and the left lens frame 3 respectively has a gaskets 23,33 each of which is formed integrally with far away from the side of each of the lens units 22,32 for touching the periphery of a wearer's eyehole. An upper and lower portions of an outer periphery of the lens frames 2,3 respectively have a first connection bases 24,34 and a second connection bases (They are located a lower portion respectively of the outer periphery of the lens frames 2,3, now shown in Figure.) the first connection bases 24,34 have a first slots 25,35 (Also, the second connection base has a second slots formed on the lower portion of the outer periphery of the lens frames 2,3). As shown in FIG. 4, an openings 241,341 in the upper portion of the outer periphery of the lens frames 2,3 for facility a first strap 50 and a second strap 51 of the strap means 5 passing through the first slots 25,35 respectively.

The strap mean 5 includes a first strap 50, a second strap 51 and a bunching element 52, wherein the first strap 50 and the second strap 51 are usually made of rubber and the bunching element 52 is formed integrally with the first strap 50 and the second strap 51 that are combined the first strap 50 and the second strap 51 at the middle in which the swimming goggles 1 is divided forming two areas by the bunching element 52. Moreover, the first strap 50 and the second strap 51 have a free ends 501,511 which are usually a plane shape and the each straps 50,51 is generally rotundity in cross section. The strap mean 5 further includes a receiving element 53, a fastener 54, wherein the receiving element 53 is a sleeve that have two through hole 531 thereon for combination the free ends 501,511 of each of the straps 50,51 together. The fastener 54 which has a adjusting hole 541,542 that are located both side of the fastener for passing through and adjusting the free ends 501,511 of each of the straps 50,51 respectively.

Figure 5:
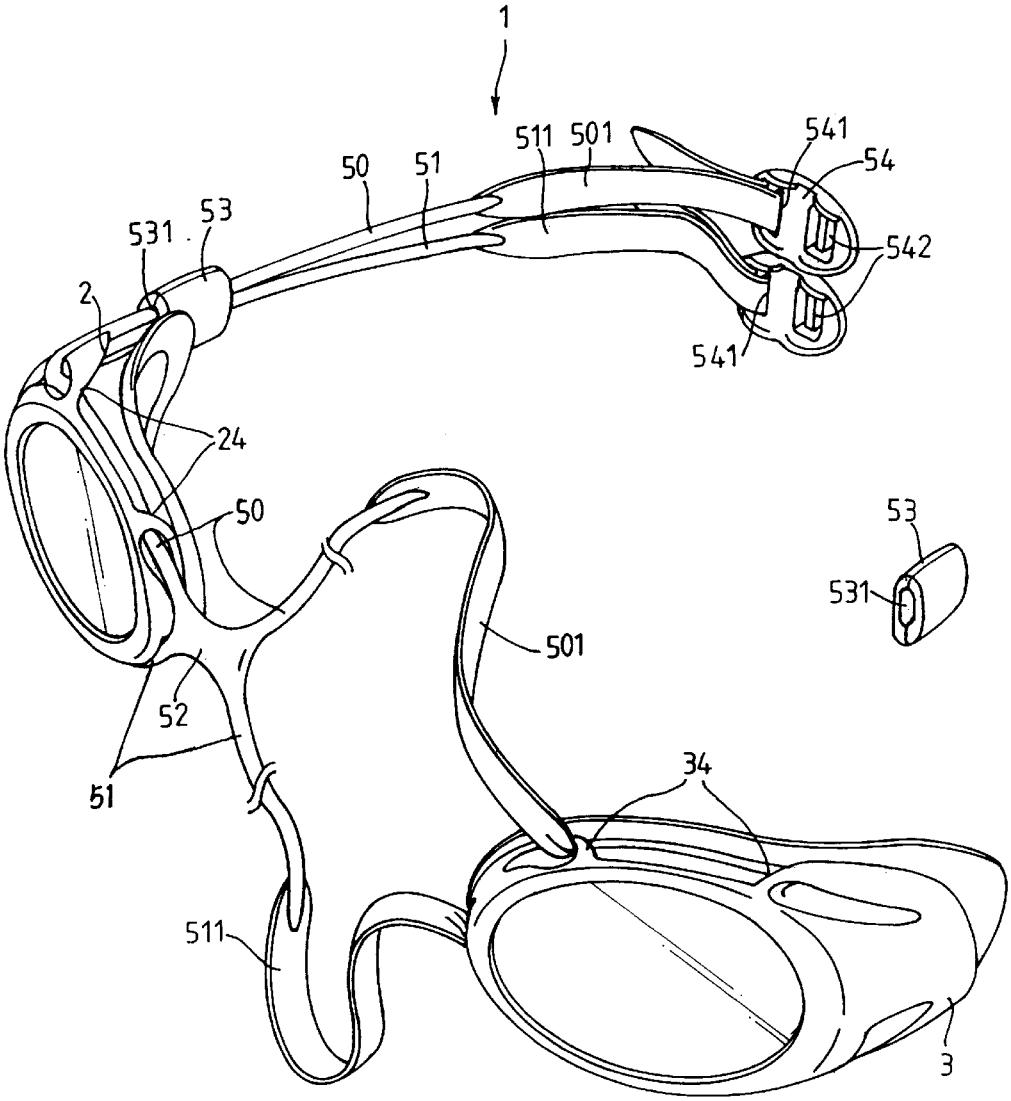
FIG. 5 is a perspective view of the part assembled of the swimming goggles in FIG. 4.
Figure 6:
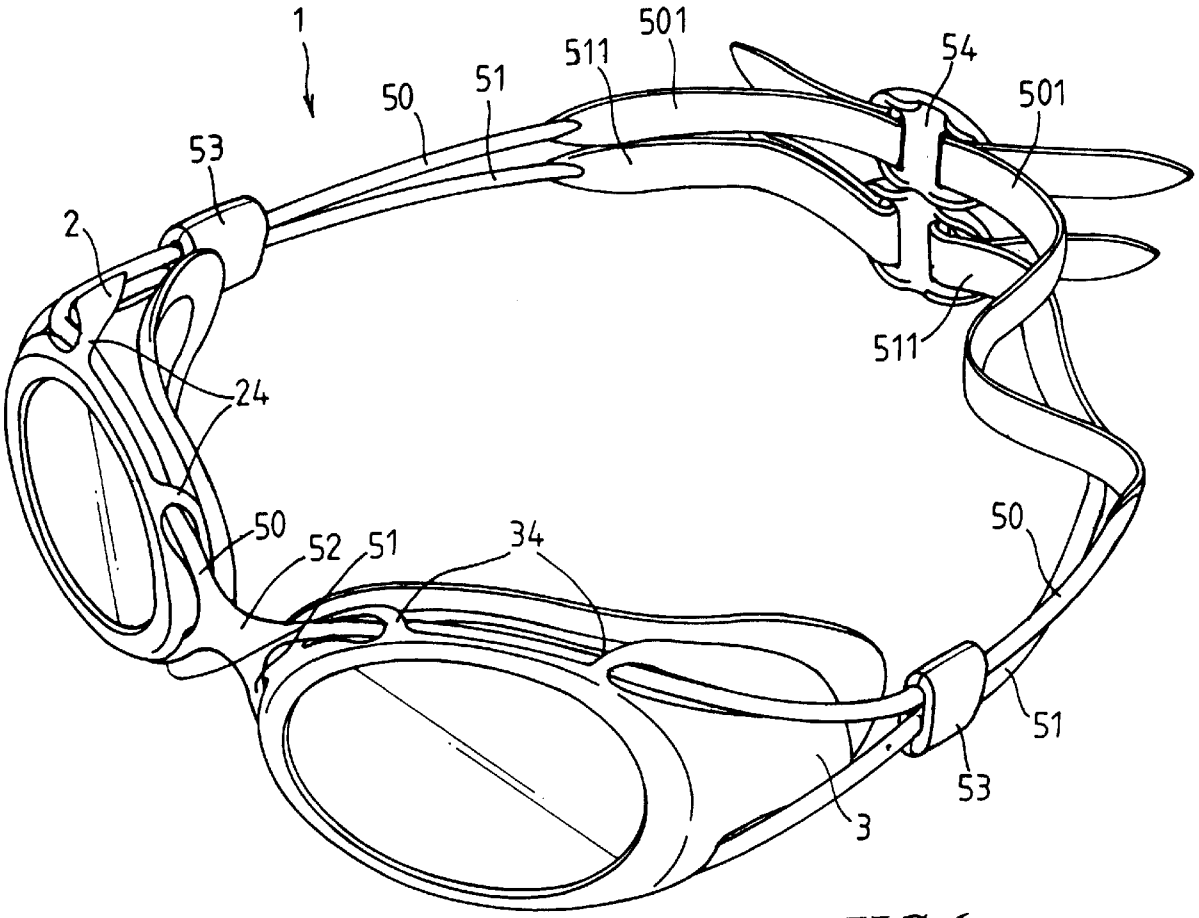
FIG. 6 is a perspective view of the swimming goggles in FIG. 4.

Referring to FIG. 5 and FIG. 6, during assembly, taking the free ends 501,511 of the first strap 50 and the second strap 51 are respectively passing through the first connection bases 24,34 of the right lens frame 2 and the left lens frame 3. As show in FIG. 5, the free ends 501,511 of the first strap 50 and the second strap 51 are assembled which have passed through the connection base 24, the receiving element 53 and the adjusting hole 541 of the fastener 54. Referring one more to FIG. 5, the left lens frame 3 is disassemble with the other free end of the first strap 50 and the second strap 51, during assembly, the free ends 501,511 of the first strap 50 and the second strap 51 are respectively passing through the connection base 34 of the left lens frame 3 and the through hole 531 of the receiving element 53, leading to the first strap 50 and the second strap 51 connection to the receiving element 53 together, and then dividing the first strap 50 and the second strap 51 pass through the adjusting hole 542 of the fastener 54 respectively, such get the same pattern in which the first strap 50 and the second strap 51 passing through the adjusting hole 541 of the fastener 54, as show the right lens frame 2 of in FIG. 5. Referring to FIG. 6, the free ends 501,511 of the first strap 50 and the second strap 51 are respectively passing through the adjusting holes 541,542 of the fastener 54 such that the first strap 50 and the second strap 51 can be securely mounted on the right lens frame 2 and the left lens frame 3.

Again referring to FIG. 7 and FIG. 8 are a top view and front view of wearing on user's head to show adjusting the span of the lens frames embodiment of the swimming goggles of the present invention. Since the first strap 50, the second strap 51 are passing through the first connection bases 24,34 of the right lens frame 2 and the left lens frame 3, thereby the right lens frame 2 and the left lens frame 3 can be respectively voluntary moved on the first strap 50, the second strap 51 and can not any influence each other, as well as the right lens frame 2 and the left lens frame 3 are not limited in adjusting angle, so as to adjust the right lens frame 2 and the left lens frame 3 matching the periphery of a wearer's eyehole without taking off the swimming goggles 1 when the swimming goggle are in adjusting (as show in FIG. 8).

Figure 7:
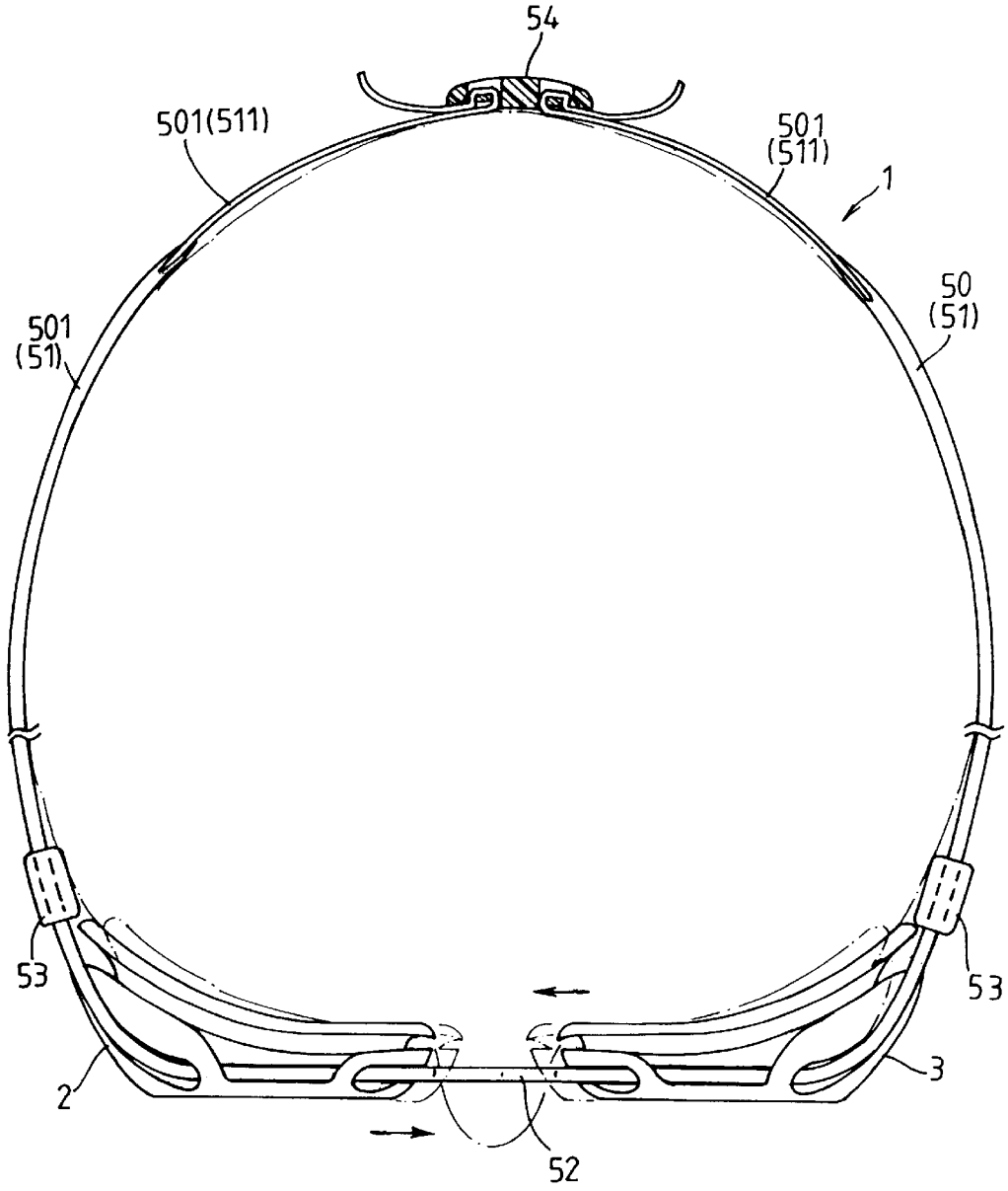
FIG. 7 is a top view of wearing on user's head and adjusting the span of lens frames of the swimming goggles in FIG. 4.
Figure 8:
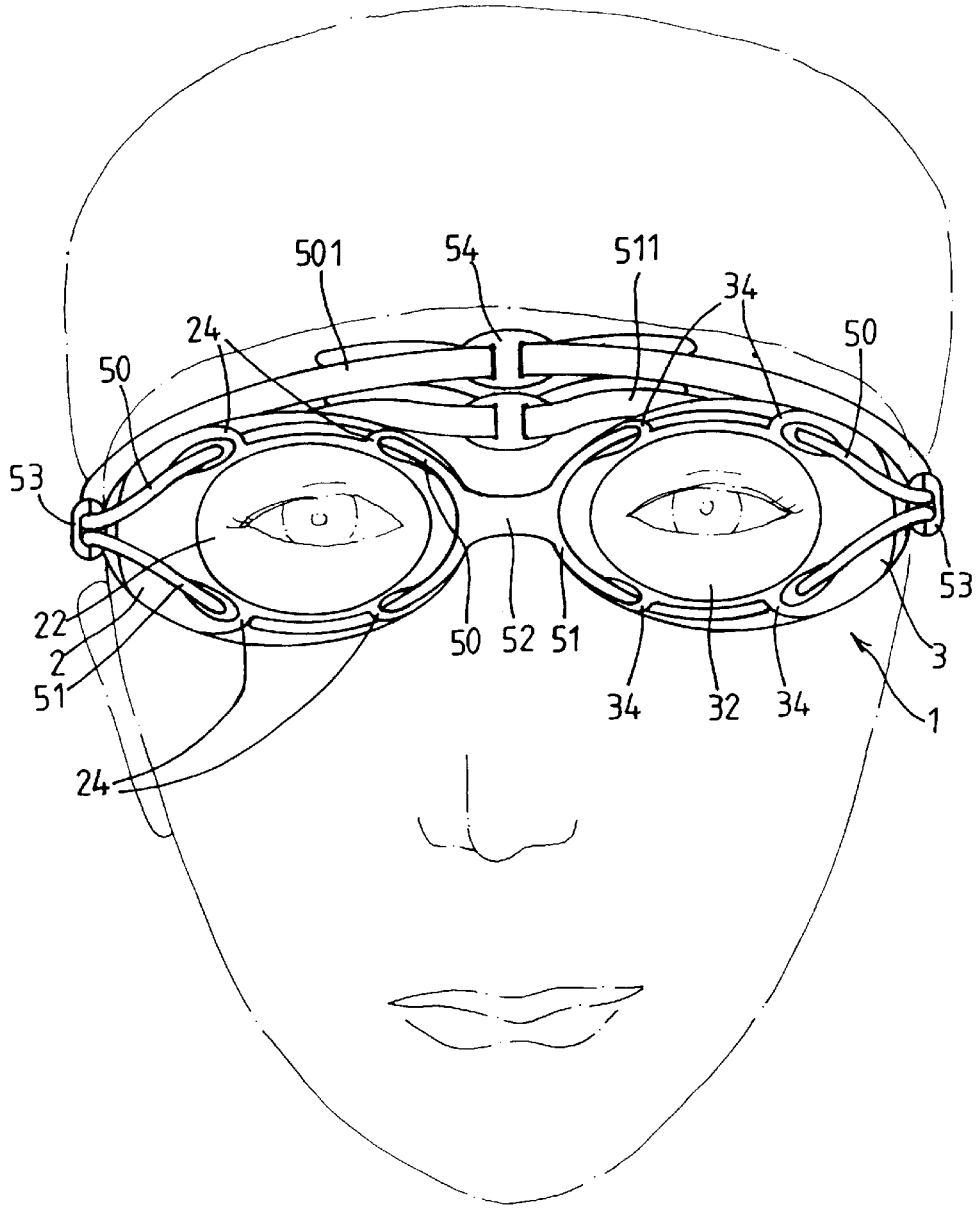
FIG. 8 is a front view of wearing on user's head embodiment of the swimming goggles of the present invention.

Referring to FIG. 7, it is obvious that the right lens frame 2 is moved toward the right direction (a broken line position and as shown in arrows), the left lens frame 3 do not move toward the same way. On the contrary, the left lens frame 3 can be voluntary moved toward the left direction by itself (a broken line position and as show in arrows) so as to enable the right lens frame 2 and the left lens frame 3 to match with the periphery of wearer's eyehole respectively, such that it can get more comfortable and prevent effectively the seepage of water when the swimming goggles are in use.

Figure 9:
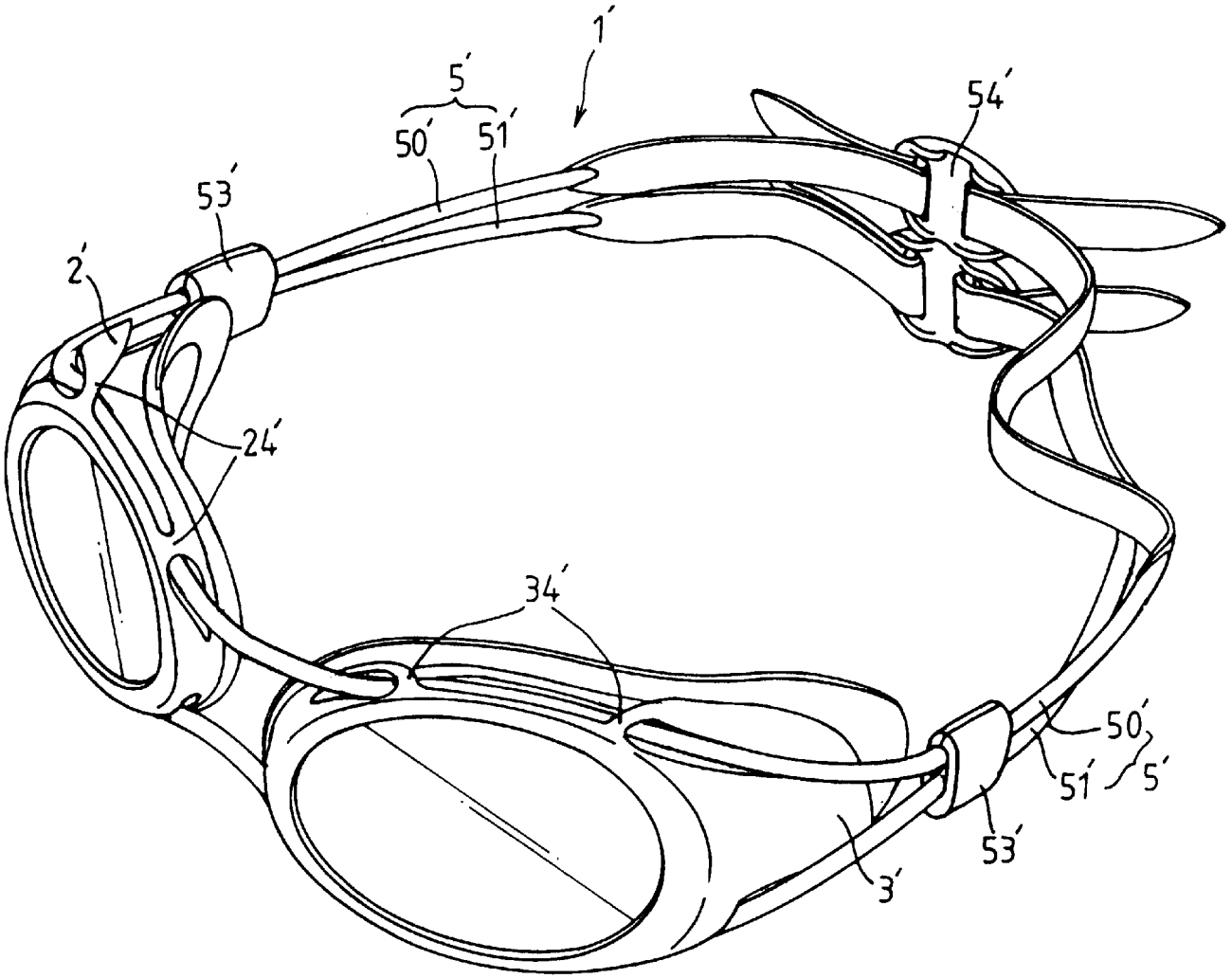
FIG. 9 is a perspective view of the second embodiment of the present invention.
Figure 10:
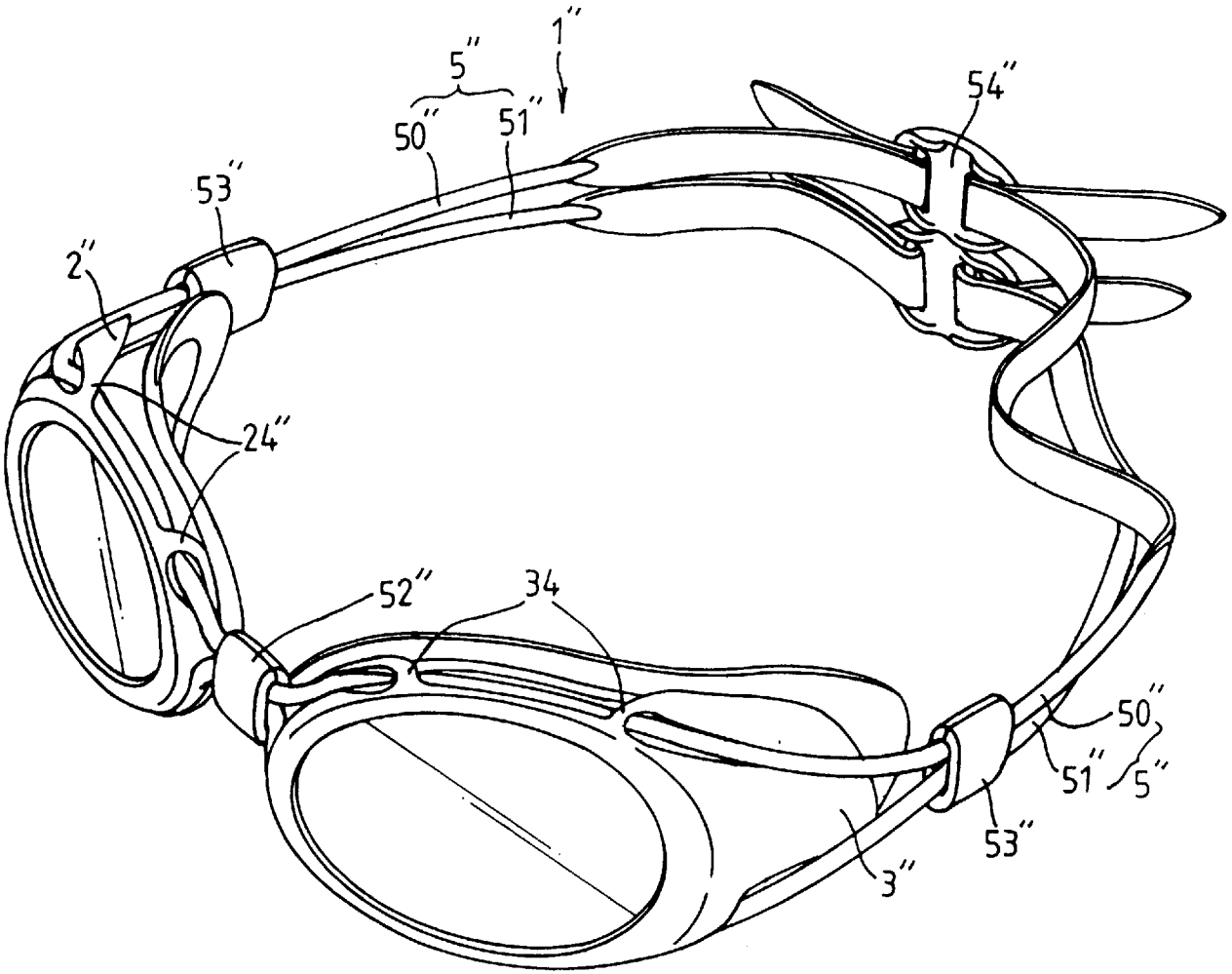
FIG. 10 is a perspective view of the third embodiment of the present invention.
Figure 11:
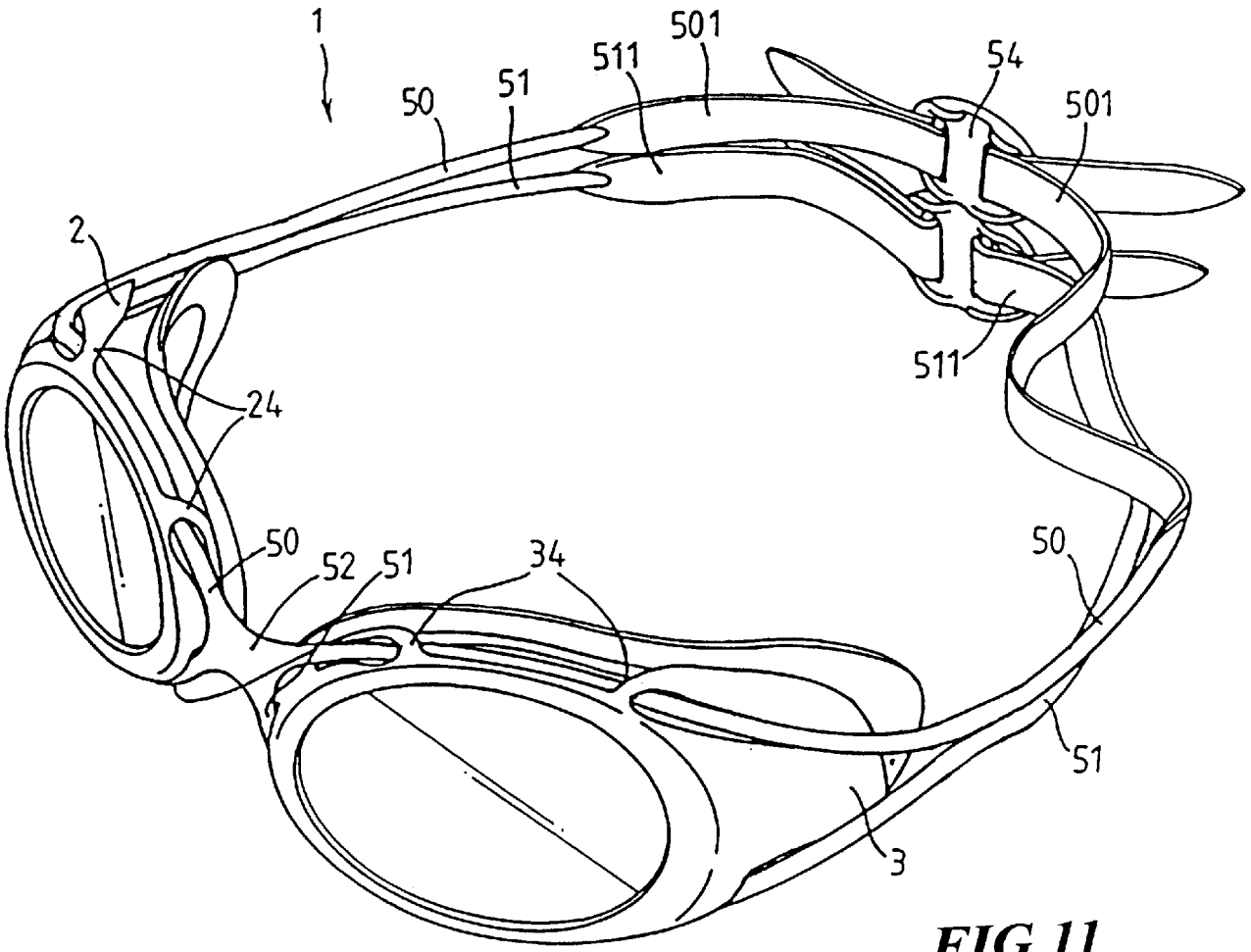
FIG. 11 and FIG. 12 are a perspective view of the swimming goggles have took off the receiving element of in FIG. 6 and FIG. 9.
Figure 12:
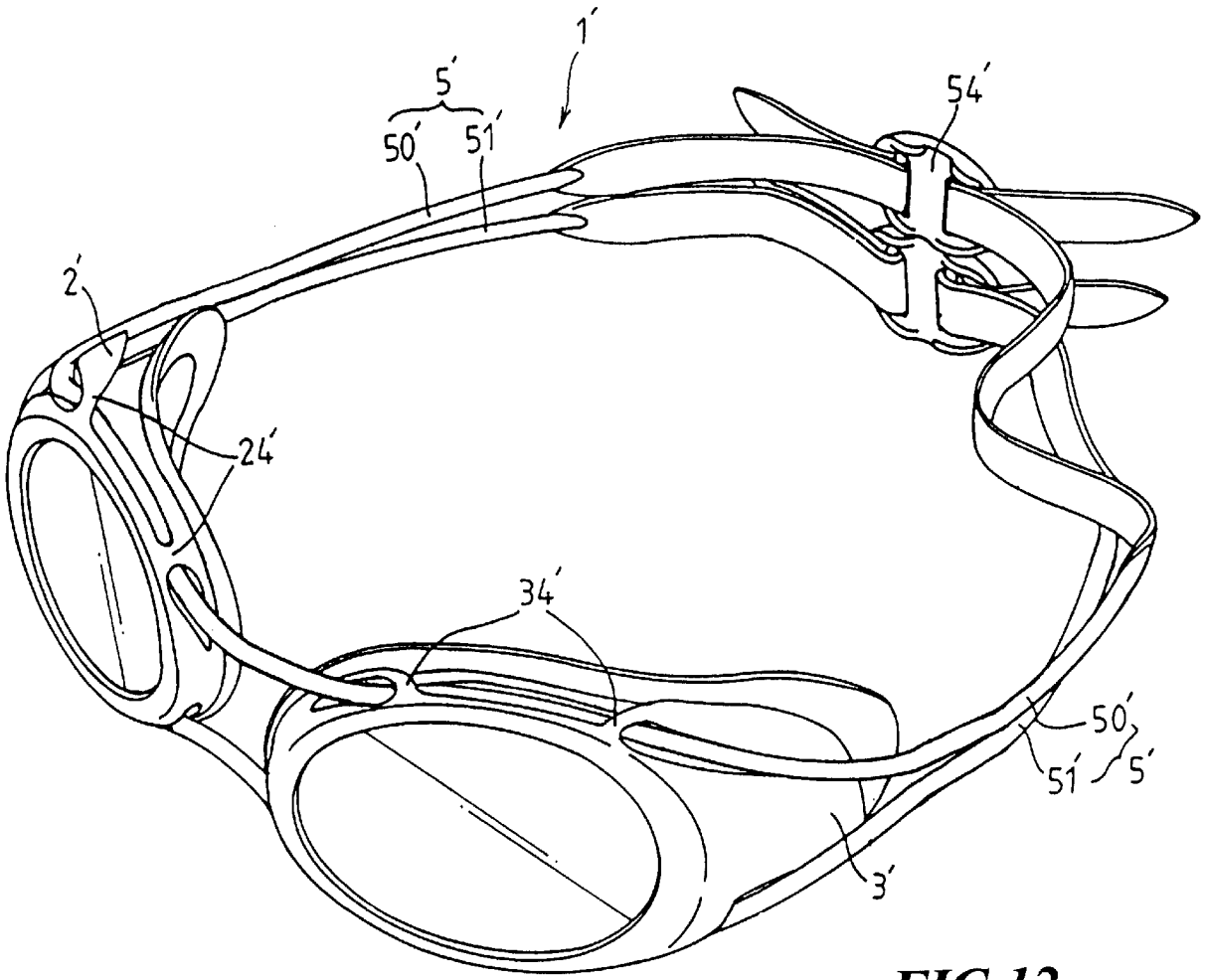

Referring to FIGS. 9–10 illustrate the second and third embodiment of a pair of swimming goggles 1',1" according to the present invention. As show in FIG. 9, the second embodiment is generally similar to the first preferred embodiment, comprising a right lens frame 2', a left lens frame 3' and a strap mean 5', the main different residing in the construction of the first strap 50' and the second strap 51' of the strap mean 5' have not a bunching element, the rest parts includes a first connection bases 24',34' of the right lens frame 2' and a left lens frame 3', a receiving element 53' which is a sleeve and a fastener 54' are all the same the first preferred embodiment, such that the right lens frame 2' and the left lens frame 3' can be respectively voluntary moved on the first strap 50' and the second strap 51' and will not any influence each other.

In addition, as shown in FIG. 10, the swimming goggles 1" is the third embodiment which is generally similar to the second preferred embodiment, comprising a right lens frame 2", a left lens frame 3" and a strap mean 5", the main different residing in the construction of the first strap 50" and the second strap 51" of the strap mean 5" have a bunching element 52" in center of each strap that the bunching element 52" is generally similar to the sleeve 53 which has showed the first preferred embodiment for combination the first strap 50" and the second strap 51" together, the rest parts includes a connection bases 24",34", of the right lens frame 2", a left lens frame 3", a receiving element 53" and a fastener 54" are all the same the first preferred embodiment, such that the right lens frame 2" and the left lens frame 3" can be respectively voluntary moved on the first strap 50" and the second strap 51" and will not any influence each other when the lens frames 2",3" are in adjusting. Moreover, the receiving elements 53,53' of in FIG. 6 and FIG. 9 would took off from the first straps 50,50' and the second straps 51,51', and each lens frames 2,3 and 2',3' can be still respectively voluntary on moved the first strap 50,50' and the second strap 51,51' and will not any influence each other when the lens frames 2,3 and 2',3' are in adjustment.

While the present invention has been described in connection with what is considered the most practical and preferred embodiment, it is understood that this invention is not limited to the disclosed embodiments but is intended to cover various arrangements, which the strap mean comprise only one strap that is passing through the left lens frame and the right lens frame, or the connection base is protrude on the left lens frame and the right lens frame, or the connection base is mounted on the left side and right side of the periphery of each lens frames etc., included within the spirit and scope of the broadest interpretation so as to encompass all such modifications and equivalent arrangements.

What is claimed is:

1. A pair of swimming goggles comprising:

a left lens frame and a right lens frame, each of which has an inner periphery defining a lens retaining space for receiving a lens unit and an outer periphery defining a first connection base and a second connection base, and a gasket formed integrally with a contact edge, strap means including a first strap and a second strap capable of passing through the first connection base and the second connection base respectively of each of the left lens frame and the right lens frame so as to assist tightening of the swimming goggles to a wearers head, and a fastener with adjusting holes located on both sides thereof for passing therethrough and adjusting the free end of each strap, and a bunching element disposed between and joining the center of the first strap and the second strap, wherein the first connection base and the second connection base are positioned on the upper and lower portions respectively of the outer periphery of each of the left lens frame and the right lens frame, the first connection base comprises a first slot formed on the upper portion of the outer periphery of the lens frame; and an opening in the upper portion of the outer periphery of the lens frame, the second connection base comprises a second slot formed on the lower portion of the outer periphery of the lens frame; and an opening in the lower portion of the outer periphery of the lens frame.

2. The swimming goggles as claimed in claim 1, wherein the free ends of each of the first strap and the second strap are substantially planar and connected by a substantially circular portion.

3. A pair of swimming goggles comprising:

a left lens frame and a right lens frame, each of which has an inner periphery defining a lens retaining space for receiving a lens unit and an outer periphery defining a first connection base and a second connection base, and a gasket formed integrally with a contact edge, strap means including a first strap and a second strap capable of passing through the first connection base and the second connection base respectively of each of the left lens frame and the right lens frame so as to assist tightening of the swimming goggles to a wearers head, and a fastener with adjusting holes located of both sides thereof for passing therethrough and adjusting the free end of each strap, and a bunching element disposed between the center of the first strap and the second strap and being formed integrally; wherein the first connection base and the second connection base are positioned on the upper and lower portions respectively of the outer periphery of each of the left lens frame and the right lens frame, the first connection base comprises a first slot formed on the upper portion of the outer periphery of the lens frame; and an opening in the upper portion of the outer periphery of the lens frame, the second connection base comprises a second slot formed on the lower portion of the outer periphery of the lens frame; and an opening in the lower portion of the outer periphery of the lens frame.

4. The swimming goggles as claimed in claim 3, wherein the free ends of each of the first strap and the second strap are substantially planar and connected by a substantially circular portion.

5. A pair of swimming goggles comprising:

a left lens frame and a right lens frame, each of which has an inner periphery defining a lens retaining space for receiving a lens unit and an outer periphery defining a first connection base and a second connection, and a gasket formed integrally with a contact edge, strap means including a first strap and a second strap capable of passing through the first connection base and the second connection base respectively of each of the left lens frame and the right lens frame so as to assist tightening of the swimming goggles to a wearers head, and a fastener with adjusting holes located on both sides thereof for passing therethrough and adjusting the free end of each strap, and a receiving element comprising a sleeve with a through-hole for combining each end of the first strap and the second strap; wherein the first connection base and the second connection base are positioned on the upper and lower portions respectively of the outer periphery of each of the left lens frame and the right lens frame, the first connection base comprises a first slot formed on the upper portion of the outer periphery of the lens frame; and an opening in the upper portion of the outer periphery of the lens frame, the second connection base comprises a second slot formed on the lower portion of the outer periphery of the lens frame; and an opening in the lower portion of the outer periphery of the lens frame.

* * * * *